US012781509B2

(12) United States Patent
Gebhardt et al.

(10) Patent No.: US 12,781,509 B2
(45) Date of Patent: Nov. 3, 2026

(54) LIGHT EMITTING HANDRAIL

(71) Applicant: InPro Corporation, Muskego, WI (US)

(72) Inventors: David R. Gebhardt, Milwaukee, WI (US); Matthew G. Bennett, New Berlin, WI (US)

(73) Assignee: InPro Corporation, Muskego, WI (US)

( * ) Notice: Subject to any disclaimer, the term of this patent is extended or adjusted under 35 U.S.C. 154(b) by 271 days.

(21) Appl. No.: 18/593,118

(22) Filed: Mar. 1, 2024

(65) Prior Publication Data

US 2025/0277371 A1 Sep. 4, 2025

(51) Int. Cl.
*E04F 11/18* (2006.01)

(52) U.S. Cl.
CPC ... *E04F 11/1804* (2013.01); *E04F 2011/1872* (2013.01)

(58) Field of Classification Search
CPC ..... E04F 11/1802; E04F 11/1804; E04F 11/1808; E04F 11/1836; E04F 11/1838; E04F 11/184; E04F 2011/1868; E04F 2011/1872
See application file for complete search history.

(56) References Cited

U.S. PATENT DOCUMENTS 3,569,689 A * 3/1971 Nestrock ..... F21V 33/006 362/146
3,825,229 A 7/1974 Bartlett et al.
3,991,537 A 11/1976 Brown
4,196,552 A 4/1980 Bartlett
4,201,359 A 5/1980 Baslow
4,353,529 A 10/1982 Brown
(Continued)

FOREIGN PATENT DOCUMENTS

CA 2730855 A1 * 8/2012 ..... F21V 33/006
CN 105275164 1/2016
(Continued)

OTHER PUBLICATIONS

U.S. Appl. No. 17/677,146, filed Feb. 22, 2022, InPro Corporation.
(Continued)

*Primary Examiner* — Amber R Anderson
*Assistant Examiner* — Kevin J Baynes
(74) *Attorney, Agent, or Firm* — Reinhart Boerner Van Deuren s.c.

(57) ABSTRACT

A handrail that includes a cover, a first endcap, a second endcap, a support member, and a lighting element is provided. The support member includes a longitudinal axis, first and second ends along the longitudinal axis, first and second lateral sides, and first and second longitudinal sides. The first lateral side of the support member is configured to be secured against a mounting surface. The first endcap is configured to mate with the first end of the support member and the second endcap is configured to mate with the second end of the support member. The cover is placed over the second lateral side of the support member and engages the first longitudinal side and the second longitudinal side of the support member. The lighting element is configured to couple to the support member in a lighting channel and emit light toward the mounting surface.

23 Claims, 6 Drawing Sheets

(56) References Cited

U.S. PATENT DOCUMENTS

| | | | | | |
|---|---|---|---|---|---|
| 4,367,517 | A * | 1/1983 | Balzer | E04F 11/1804 | 362/306 |
| 4,858,087 | A * | 8/1989 | Hartshorn | F21V 21/112 | 362/225 |
| 5,165,643 | A | 11/1992 | Shreiner | | |
| 5,273,258 | A | 12/1993 | Bedics | | |
| 5,288,048 | A * | 2/1994 | Shreiner | E04F 19/026 | 248/251 |
| 5,469,682 | A | 11/1995 | Knight | | |
| 5,743,064 | A | 4/1998 | Bennett | | |
| 5,779,228 | A * | 7/1998 | Hansen | B60Q 3/44 | 256/65.05 |
| 5,908,185 | A | 6/1999 | Collette et al. | | |
| 6,145,996 | A * | 11/2000 | Shimada | E04F 11/1802 | 362/240 |
| 6,508,458 | B1 | 1/2003 | Bartlett et al. | | |
| 6,932,328 | B2 * | 8/2005 | Shreiner | E04F 11/1804 | 403/348 |
| 7,144,139 | B2 * | 12/2006 | Kramer | E04F 19/06 | 362/240 |
| 7,419,276 | B2 * | 9/2008 | Sheridan | F21S 4/20 | 362/151 |
| 7,441,919 | B2 * | 10/2008 | Sheridan | F21S 4/20 | 362/151 |
| 8,210,705 | B2 * | 7/2012 | Pesson | F21V 23/0442 | 362/276 |
| 8,388,214 | B1 * | 3/2013 | Toro | F21V 3/062 | 362/147 |
| 8,876,324 | B2 * | 11/2014 | Seehof | B60Q 1/247 | 362/222 |
| D733,324 | S | 6/2015 | Daniels et al. | | |
| D733,327 | S | 6/2015 | Daniels et al. | | |
| 9,644,836 | B1 | 5/2017 | Field et al. | | |
| 9,746,152 | B2 * | 8/2017 | Poole | B63B 17/04 | |
| 9,850,664 | B2 * | 12/2017 | Pinheiro | E04F 11/1804 | |
| 10,480,195 | B2 | 11/2019 | Warshaw | | |
| 10,813,455 | B2 | 10/2020 | Ustach et al. | | |
| 11,885,136 | B2 | 1/2024 | Holten et al. | | |
| 2004/0227135 | A1 | 11/2004 | Shreiner et al. | | |
| 2006/0272255 | A1 | 12/2006 | Honda | | |
| 2010/0252792 | A1 * | 10/2010 | Bennett | A47K 17/022 | 256/65.01 |
| 2012/0212954 | A1 * | 8/2012 | Hirai | F21V 19/005 | 362/223 |
| 2013/0058074 | A1 * | 3/2013 | Somei | F21V 33/006 | 362/145 |
| 2013/0155679 | A1 * | 6/2013 | Quinn | E04F 11/1836 | 362/249.02 |
| 2017/0234523 | A1 * | 8/2017 | Krijn | E04F 19/0436 | 362/145 |
| 2017/0336064 | A1 * | 11/2017 | Simon | F21S 4/28 | |
| 2019/0338940 | A1 * | 11/2019 | Shepherd | F21V 31/00 | |
| 2020/0318357 | A1 * | 10/2020 | Bennett | E04F 11/1808 | |

FOREIGN PATENT DOCUMENTS

| | | | | |
|---|---|---|---|---|
| CN | 107842154 | A * | 3/2018 | E04F 11/1804 |
| CN | 112982856 | A * | 6/2021 | F21V 19/00 |
| DE | 102012107008 | A1 * | 2/2014 | E04F 11/1802 |
| DE | 102019212114 | B3 * | 1/2021 | F21V 33/006 |
| EP | 1643055 | | 4/2006 | |
| GB | 2475328 | A * | 5/2011 | F21S 8/02 |
| JP | H06248772 | A | 9/1994 | |
| JP | 2001323623 | A | 11/2001 | |
| KR | 100979675 | B1 * | 9/2010 | E04F 11/1836 |
| KR | 20140000566 | U * | 1/2014 | E04F 11/1836 |
| WO | WO-0183912 | A2 * | 11/2001 | E04F 11/166 |
| WO | WO-2020255910 | A1 * | 12/2020 | E04F 11/181 |

OTHER PUBLICATIONS

New York State Office of Mental Health, "Patient Safety Standards, Materials and Systems Guidelines," pp. 90-94, 21st Edition, Mar. 11, 2019, accessed on the internet [https://www.omh.ny.gov/omhweb/patient_safety_standards/guide.pdf], 211 pages.

Construction Specialties Group, "HRB-4CCMN," Dec. 12, 2012, accessed on the Internet [https://www.c-sgroup.com/files/tech-center/acrovyn/cad/pdf/hrb4ccmn.pdf], 1 page.

Construction Specialties Group, "HRB-4CCMN Handrail with Ligature Resistant Mounting Bracket," Installation Guide, Mar. 27, 2015, accessed on the Internet [https://www.c-sgroup.com/files/tech-center/acrovyn/install/pdf/24hrb4ccmn.pdf], 7 pages.

Construction Specialties Group, "HRB-20CMN Acrovyn 4000," Dec. 12, 2012, accessed on the Internet [https://www.c-sgroup.com/files/tech-center/acrovyn/cad/pdf/hrb-20cmn.pdf], 1 page.

Construction Specialties Group, "HRB-20CMN Handrail with Ligature Resistant Mounting Bracket," Dec. 12, 2012, accessed on the Internet [https://www.c-sgroup.com/files/tech-center/acrovyn/install/pdf/hrb-20cmn.pdf], 7 pages.

Pawling Corporation, "Pro Tek Installation Instruction, BR-500 Series Handrail with Continuous Security Bracket," available on Jan. 10, 2019, 4 pages.

Pawling Corporation, "Pro Tek Installation Instruction, BR-400V Series Handrails," available on Jan. 10, 2019, 4 pages.

* cited by examiner

LIGHT EMITTING HANDRAIL

BACKGROUND OF THE INVENTION

The present invention relates generally to the field of handrails. The present invention relates specifically to handrails having lighting systems capable of emitting light and/or providing ambient or accent room lighting.

SUMMARY OF THE INVENTION

One embodiment of the invention relates to a handrail configured to be installed on a mounting wall. The handrail includes an elongate support member having a first longitudinal end, a second longitudinal end, and a longitudinal axis extending through the first longitudinal end and the second longitudinal end. The support member includes a base member having a first side that faces toward the mounting wall when the support member is installed and a second side that faces away from the mounting wall when the support member is installed. The support member includes a channel formed in the first side and extending in a direction parallel to the longitudinal axis and a mounting arm extending from the first side of the base member, the mounting arm being configured to engage the mounting wall when the support member is installed. The handrail includes a cover configured to couple to the support member. The cover includes a substantially continuous surface configured to engage the first side of the base member at a first location that is beneath the mounting arm, cover the second side of the base member, and engage the base member at a second location that is above the mounting arm. The handrail includes a lighting element coupled to the base member within the channel such that light emitted by the lighting element is directed away from the second side of the base member. The base member is a separate, discontinuous component from the cover such that the cover can be coupled to and removed from the base member while the lighting element is coupled to the base member.

Another embodiment of the invention relates to a handrail configured to be installed on a mounting wall. The handrail includes an elongate support member having a first longitudinal end, a second longitudinal end, and a longitudinal axis extending through the first longitudinal end and the second longitudinal end. The support member includes a base member having a first side that faces toward the mounting wall when the support member is installed and a second side that faces away from the mounting wall when the support member is installed. The base member includes a channel that extends in a direction parallel to the longitudinal axis and a mounting arm extending from the first side of the base member. The mounting arm is configured to engage the mounting wall when the support member is installed. The handrail includes a cover configured to couple to the support member. The cover includes a substantially continuous surface configured to engage the first side of the base member at a first location that is beneath the mounting arm, cover the second side of the base member, and engage the base member at a second location that is above the mounting arm. The handrail includes a lighting element coupled to the base member within the channel. The lighting element includes a power cord for directing electrical energy to the lighting element from a power source. The handrail includes an endcap having a first endcap end and a second endcap end, the endcap coupled to the first longitudinal end of the support member at the first endcap end, and the endcap forming an arcuate shape that defines an arc between the first endcap end and the second endcap end. The power cord of the lighting element passes through the endcap from the lighting element to the mounting wall. An outer surface of the cover abuts and aligns substantially flush with an outer surface of the endcap.

Another embodiment of the invention relates to a handrail configured to be installed on a mounting wall. The handrail includes an elongate support member having a first longitudinal end, a second longitudinal end, and a longitudinal axis extending through the first longitudinal end and the second longitudinal end. The support member includes a base member having a first side that faces toward the mounting wall when the support member is installed and a second side that faces away from the mounting wall when the support member is installed. The support member includes a channel formed in the first side and extending in a direction parallel to the longitudinal axis and a mounting arm extending from the first side of the base member, the mounting arm being configured to engage the mounting wall when the support member is installed. The handrail includes a cover configured to couple to the support member. The cover includes a substantially continuous surface configured to engage the first side of the base member at a first location that is beneath the mounting arm, cover the second side of the base member, and engage the base member at a second location that is above the mounting arm. The handrail includes a lighting element coupled to the base member within the channel such that light emitted by the lighting element is directed away from the second side of the base member. The channel is configured such that the lighting element can be installed in and removed from the base member while the handrail is installed on the mounting rail and while the cover is coupled to the support member.

Additional features and advantages will be set forth in the detailed description which follows, and, in part, will be readily apparent to those skilled in the art from the description or recognized by practicing the embodiments as described in the written description and claims thereof, as well as the appended drawings. It is to be understood that both the foregoing general description and the following detailed description are exemplary.

The accompanying drawings are included to provide further understanding and are incorporated in and constitute part of the specification. The drawings illustrate one or more embodiment, and together with the description serve to explain the principles and operation of various embodiments.

Alternative exemplary embodiments relate to other features and combinations of features as may be generally recited in the claims.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Generally, a handrail that includes a lighting element for providing ambient or accent lighting in a hallway or room is described. The handrail includes an independent wall-facing channel configured to receive and retain a lighting element. The wall-facing channel allows users to install the lighting element prior to installing the handrail to a wall or after the handrail is installed without disrupting the finish of the handrail facing away from the wall. In some embodiments, the wall-facing channel is formed in a separate component than a cover of the handrail, allowing users to replace the handrail cover without disrupting the lighting element. These and other advantages will be discussed in relation to the exemplary embodiments provided below.

Figure 1:
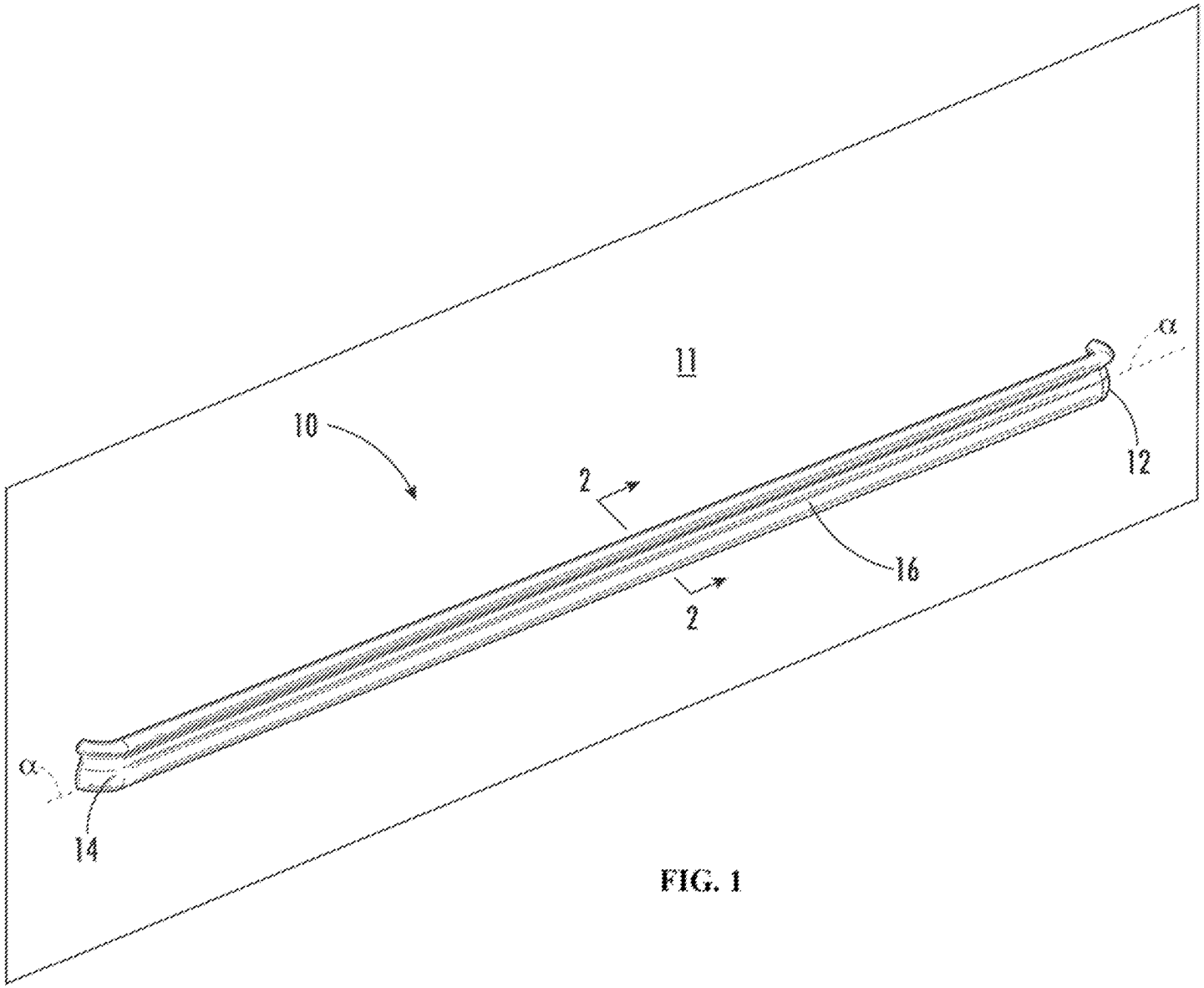
FIG. 1 depicts a perspective view of a handrail system, according to an exemplary embodiment.

Referring to the FIG. 1, a handrail 10 is shown, according to an exemplary embodiment. As shown in FIG. 1, the handrail 10 is attached to a mounting surface 11, such as a wall of a building. The handrail 10 includes a first endcap 12, a second endcap 14, and a handrail cover 16 that is disposed between the first endcap 12 and the second endcap 14. The endcaps 12, 14 may also be referred to as "returns." As seen in the embodiment depicted in FIG. 1, the endcaps 12, 14 and cover 16 define a substantially continuous surface along longitudinal axis a having corresponding curvatures going from the top of the handrail system 10 to the bottom of the handrail 10 (with respect to the orientation shown in FIG. 1). In embodiments, the cover 16 and the endcaps 12, 14 each comprise a plastic material. In particular, the cover 16 and endcaps 12, 14 are preferably made from an impact resistant plastic. In an embodiment, the cover 16 is made from PVC. Further, in embodiments, the cover 16 is an extruded component. In embodiments, the endcaps 12, 14 are made from PVC or ABS. In embodiments, the endcaps 12, 14 are molded, e.g., injection molded, or made through additive manufacturing, e.g., 3D-printing.

Figure 2:
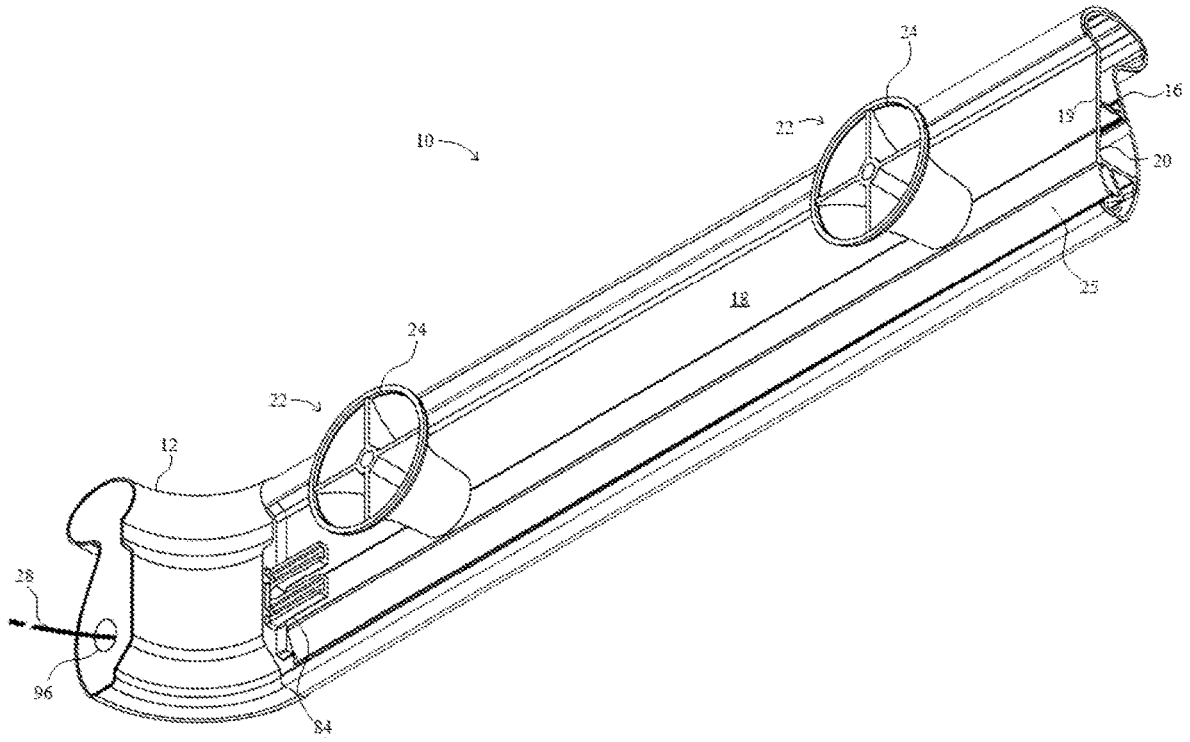
FIG. 2 depicts a cross-sectional perspective view of the handrail system of FIG. 1, taken along line 2-2, according to an exemplary embodiment.

FIG. 2 provides a perspective and partial-sectional view of the handrail 10, showing the rear, wall-facing side of the handrail 10. The cover 16 is snapped over a handrail support member 18, which will be discussed in more detail in relation to FIG. 3. Additionally, the endcap 12 engages an end of the handrail support member 18, as will be discussed more fully below in relation to FIG. 5.

Referring to FIG. 2, the support member 18 includes a central strip 20 that, when installed, is substantially parallel to the mounting surface 11. One or more mounting arms 22 extend substantially perpendicularly from a first lateral side 19 of the central strip 20 that faces toward the mounting surface 11, when installed. In some embodiments, a cross-section in the plane perpendicular to the direction in which mounting arm 22 extends of mounting arm 22 has a substantially circular perimeter. The diameter of the substantially circular perimeter of mounting arm 22 increases as mounting arm 22 extends away from central strip 20. Mounting arm 22 includes a mounting end 24. Mounting end 24 is configured to abut mounting surface 11 when installed.

As shown in FIG. 2, a lighting assembly 25 is coupled to a support member 18. Lighting assembly 25 is positioned on a side of support member 18 that faces mounting surface 11 when installed such that lighting assembly 25 emits light toward mounting surface 11.

Figure 3:
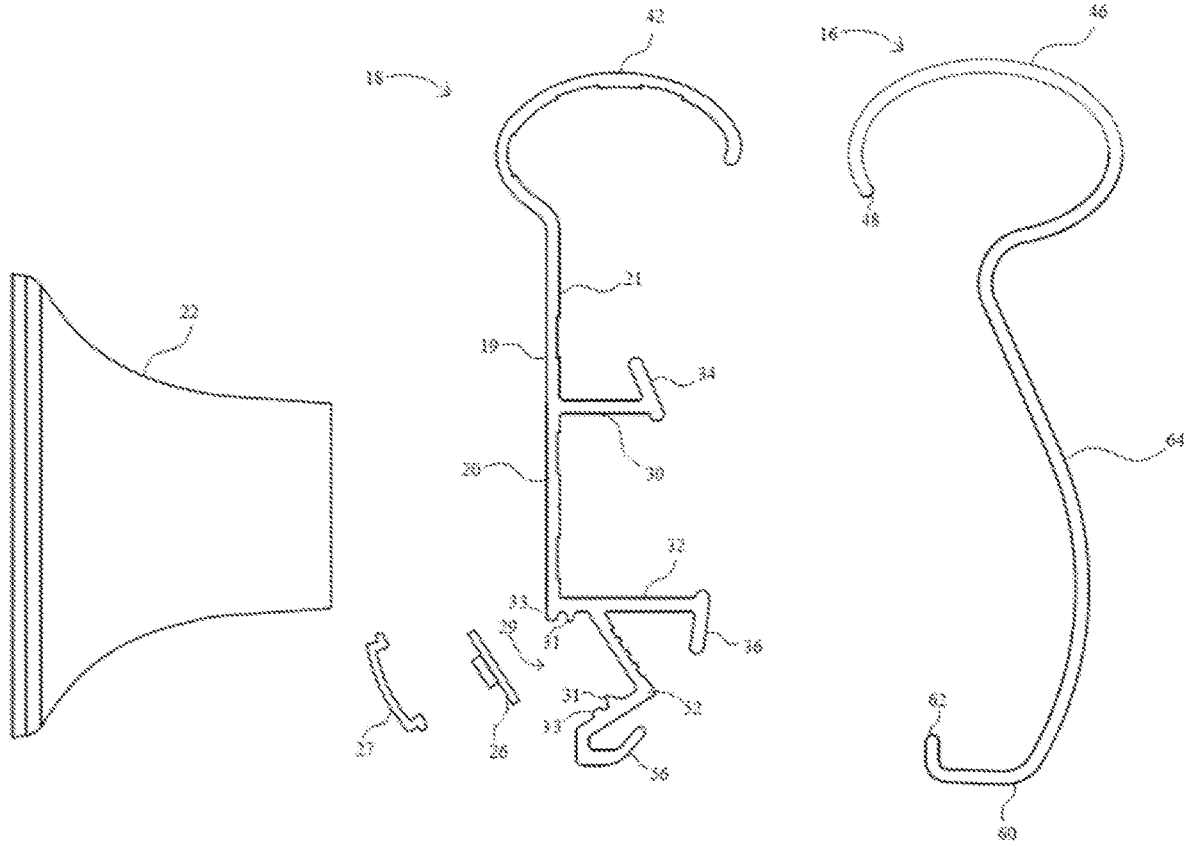
FIG. 3 depicts an exploded cross-sectional view of the handrail system of FIG. 1, taken along line 2-2, according to an exemplary embodiment.

Turning to FIG. 3, an exploded, cross-sectional view of the support member 18 and the cover 16 taken along the longitudinal axis a is shown. In embodiments, the support member 18 is made from extruded aluminum. Advantageously, each of the structures shown in the cross-sectional view of FIG. 3, and that will be discussed below, can be formed directly in the extrusion process. In other embodiments, the support member 18 can be made from another material, such as a different metal, plastic, or wood.

As shown in FIG. 3, lighting assembly 25 includes a lighting element 26 and a lighting cover 27. In a specific embodiment, lighting element 26 is an LED strip including a plurality of light emitting diodes (LEDs). In some embodiments, lighting element 26 includes a plurality of light emitting features such that lighting element 26 emits light from a plurality of discrete locations. In other embodiments, lighting element 26 is a singular linear lighting element such that light is emitted from a continuous length of lighting assembly 25. Lighting cover 27 is a lens formed from a clear PVC material. In other embodiments, lighting cover 27 can be formed from clear polycarbonate, other clear plastic materials, or any other transparent or translucent material.

Support member 18 includes a lighting channel 29 configured to receive and retain lighting element 26 and lighting cover 27. Lighting channel 29 includes protrusions 31 that extend into lighting channel 29 and retain lighting element 26 and lighting cover 27 in lighting channel 29. In some embodiments, lighting cover 27 is flexible such that lighting cover 27 snaps into lighting channel 29 between protrusions 31 and retaining edges 33. Protrusions 31 prevent lighting cover 27 from being pushed further into lighting channel 29 and/or from contacting lighting element 26. Lighting channel 29 is positioned on a side of support member 18 that faces toward mounting surface 11 when installed. Referring back to FIG. 2, lighting assembly 25 and lighting channel 29 extend substantially the entire length of support member 18 in a direction parallel to longitudinal axis a. Lighting channel 29 is angled such that lighting channel 29 opens toward mounting surface 11 and/or in a partially downward direction. This configuration results in the light emitted by lighting assembly 25 being directed toward mounting surface 11 and/or toward the ground below handrail 10. In a specific embodiment, a majority of the light emitted by lighting assembly 25 is incident on mounting surface 11, rather than the ground below handrail 10, such that light assembly 25 provides ambient and/or accent lighting when installed in a hallway or room and is not used for emergency wayfinding lighting or direct-to-floor wayfinding lighting. Lighting cover 27 can be translucent such that lighting assembly 25 produces diffuse ambient lighting or room accent lighting.

Figure 4:
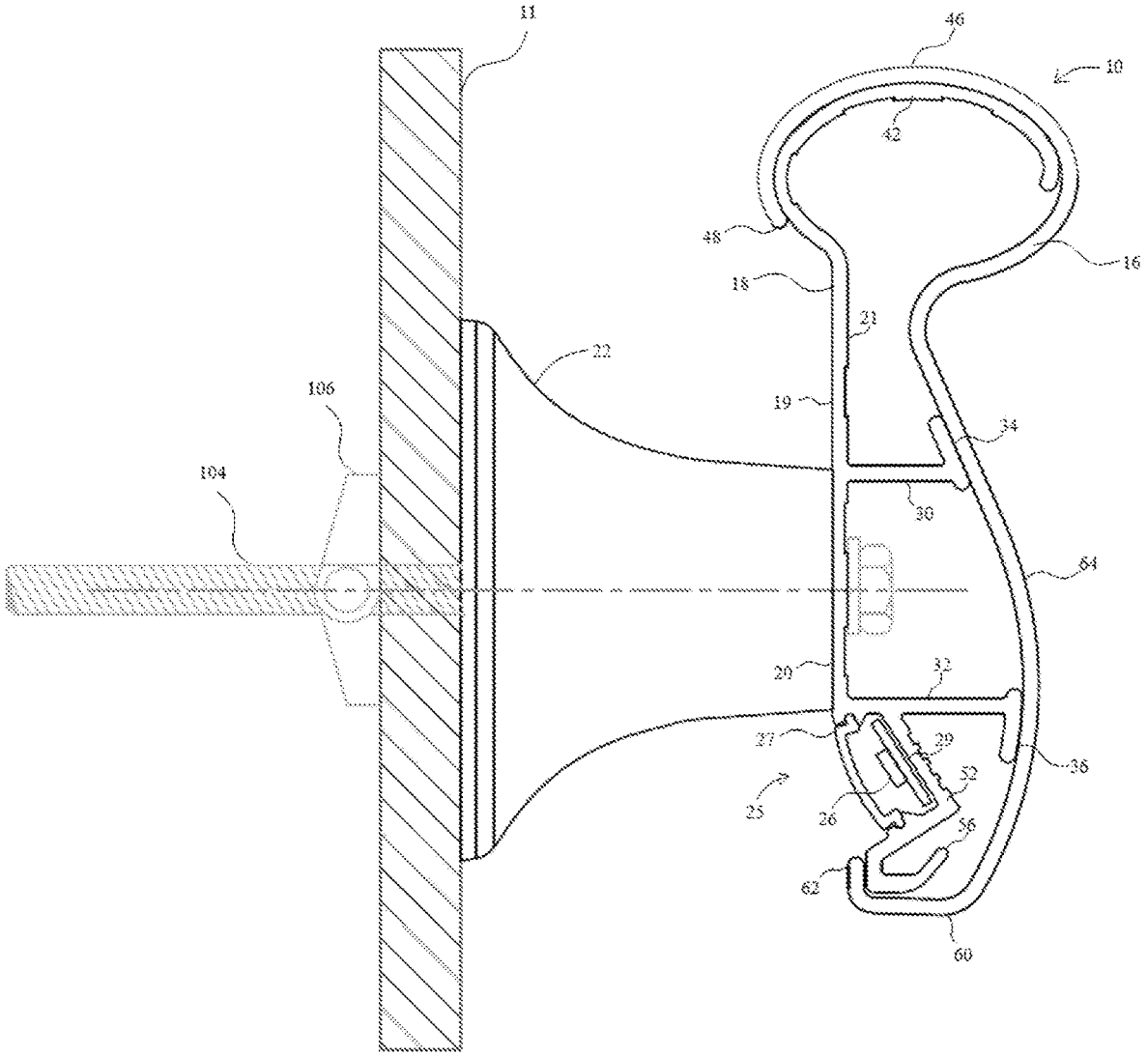
FIG. 4 depicts a cross-sectional view of the handrail system of FIG. 1 mounted to a mounting surface, according to an exemplary embodiment.

Referring to FIG. 4, central strip 20 includes a second lateral side 21 that faces away from mounting surface 11, when installed. A first support arm 30 and a second support arm 32 extend away from second lateral side 21 of the central strip 20. The first support arm 30 is in line with an upper edge of mounting arm 22 such that the central strip 20, mounting arm 22, and first support arm 30 form a junction in the support member 18. The second support arm 32 is in line with a lower edge of mounting arm 22 such that the central strip 20, mounting arm 22, and second support arm 32 also form a junction in the support member 18. The support arms 30, 32 are designed to provide support for the cover 16 so that the cover 16 maintains its contour when installed on the support member 18. In furtherance of this function, a first support panel 34 is disposed at an end of the first support arm 30, and a second support panel 36 is disposed at an end of the second support arm 32. As can be seen in FIG. 4, the support panels 34, 36 are angled relative to the support arms 30, 32 to match the contour of the cover 16 in the region in which the cover 16 contacts the support panels 34, 36.

The support member 18 includes a curved support section 42 on the upper side of support member 18 creating a curved surface over which the cover 16 is supported. The cover 16 includes a first curved section 46 having a curvature that substantially matches the curvature of the curved support section 42 and that hooks over the curved support section 42, and a first edge 48 of the cover 16.

On a lower of the support member 18 opposite to the curved extension 38 is a lower extension 52. Lower extension 52 forms lighting channel 29. Further, extending from the lower extension 52 below lighting channel 29 is a ledge 56. As shown in FIGS. 3 and 4, the cover 16 includes a second curved section 60 with a second edge 62. The second curved section 60 is configured to slide over the front face of and around the ledge 56 such that the second edge 62 abuts or is in close proximity to ledge 56 near the opening of lighting channel 29.

Between the first curved section 46 and the second curved section 60 of the cover 16 is a contoured section 64. The contoured section 64 can be of any of a variety of suitable contours available for handrail designs. In a specific embodiment, first curved section 46, second curved section 60, and contoured section 64 of cover 16 are configured such that handrail 10 has a curved upper section that extends closer to mounting surface 11 than the central strip 20. In some embodiments, the curvature of cover 16 is convex near first curved section 46 and second curved section 60 and concave for at least a portion of contoured section 64. As mentioned above, the support panels 34, 36 maintain the contour of the contoured section 64. Further, in embodiments, the cover 16 is formed in such a way and from such a material that the cover 16 is flexed to fit it over the curved support section 42 and the ledge 56. In this way, the cover 16 will be in tight engagement with the curved support section 42, the support panels 34, 36, and the ledge 56. Advantageously, the tight engagement diminishes any wiggle room or play between the cover 16 and the support member 18.

Cover 16 is configured to be a separate, discontinuous component from support member 18 such that cover 16 can be attached to and/or removed from support member 18 while lighting assembly 25 is installed within support member 18. As such, lighting channel 29 is separate from a handrail portion of support member 18 over which cover 16 extends, when cover 16 is attached to support member 18. Lighting channel 29 is positioned above a bottom end of cover 16 such that lighting assembly 25 can be installed in or removed from support member 18 while cover 16 is attached to support member 18. As such, lighting assembly 25 can be removed, replaced, and/or repaired without disrupting the visible finish of handrail system 10. Lighting assembly 25 can also be installed in support member 18 before installing handrail system 10 to mounting surface 11 or before attaching cover 16 to support member 18.

Figure 5:
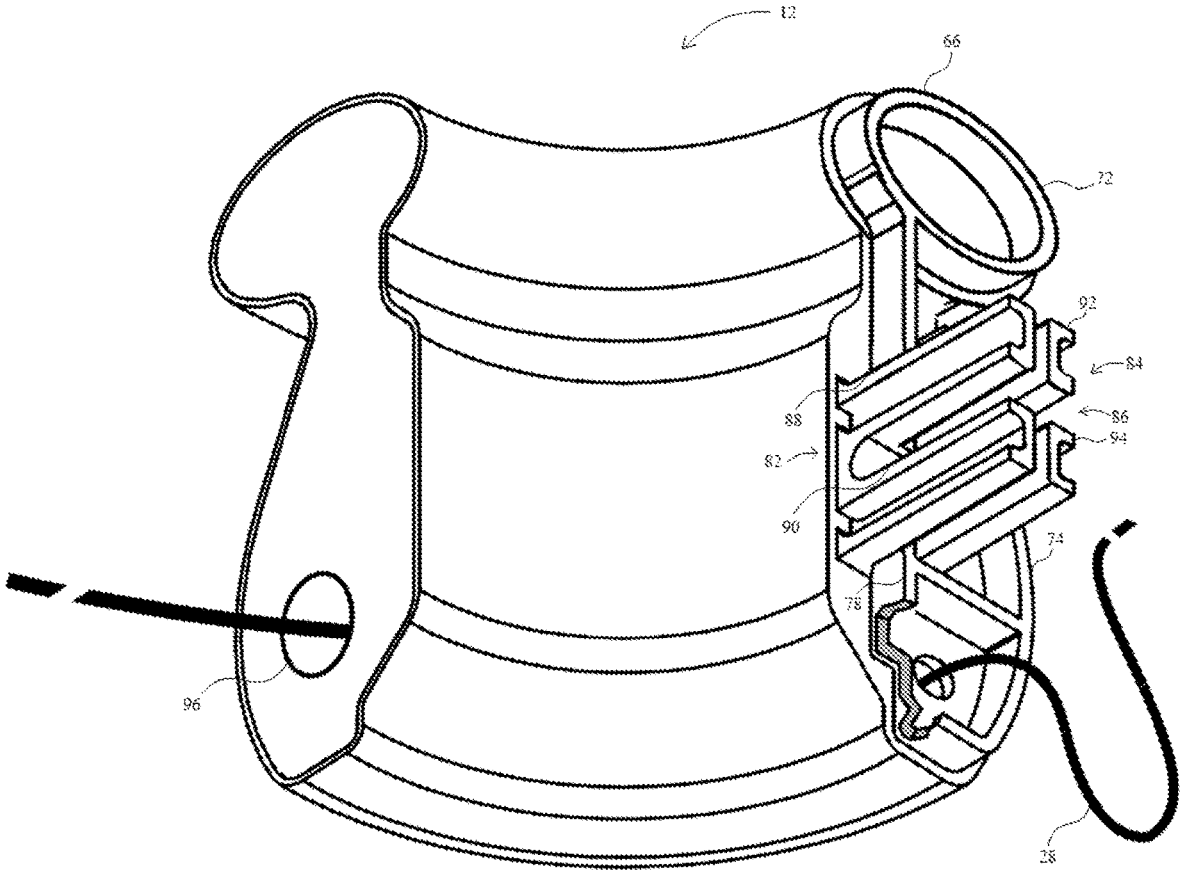
FIG. 5 depicts an isolated perspective view of an endcap of the handrail system of FIG. 1, according to an exemplary embodiment.

With reference now to FIG. 5, endcap 12 is shown. Endcap 14 is substantially similar to endcap 12 but is a mirror inverse structure. Thus, discussion of endcap 12 applies as well to endcap 14. The endcaps 12, 14 are configured to mate with the support member 18. As shown in FIG. 4, the endcap 12 includes an engagement section 66 having a curved support section 72 configured to be retained within curved support section 42 of the support member 18.

Further, the endcap 12 also includes a contoured ridge 74 that extends substantially perpendicularly from a side surface 76 of the endcap 12. The contoured ridge 74 is similar in function to the support panels 34, 36 and to the ledge 56 of the support member 18 as shown in FIG. 3. That is, the contoured ridge 74 supports the contoured section 64 of the cover 16 and provides a structure for the second edge 62 of the cover 16 to slide over and around. Thus, the contoured ridge 74 extends along the side of endcap 12 from a location proximal to the curved support section 72 downwardly to the bottom (with respect to the orientation shown in FIG. 4) of endcap 12, curves toward the mounting surface 11 and then back upwardly to form a central ridge 78, leading to the curved support section 72.

The endcap 12 includes multiple structures configured to engage the support member 18. Extending from the side surface 76 of the endcap 12 are a first plank 82 and a second plank 84. The first plank 82 extends from a first side of the central ridge 78, and the second plank 84 extends from a second side of the central ridge 78. In this way, the planks 82, 84 are separated by at least a distance corresponding to the thickness of the central ridge 78. In this way, the planks 82, 84 define a slot 86 adapted to receive the central strip 20 of the support member 18. In a specific embodiment, first plank 82 includes a first upper arm 88 and a first lower arm 90 that are spaced vertically from each other such that there is a gap between first upper arm 88 and first lower arm 90. Similarly, second plank 84 includes a second upper arm 92 and a second lower arm 94 that are spaced vertical from each other such that there is a gap between a second upper arm 92 and a second lower arm 94.

As can be seen in FIG. 5, the endcap 12 has an arcuate structure. Specifically, the endcap 12 extends in an arc through an angle of about 90°. In this way, the endcap 12 caps the cover 16 and support member 18, which are arranged parallel to the mounting surface, and transitions the end of the handrail system 10 into the wall. However, in other embodiments the endcaps 12, 14 can instead be inside or outside corners that join sections of the handrail system 10. That is, where two mounting surfaces meet, a first support member 18 and cover 16 can be installed on one mounting surface 11, and a second support member 18 and cover 16 can be installed on the other mounting surface 11. The two sections can be joined at the corner where the mounting surfaces meet, e.g., an inside corner where the angle between the mounting surfaces 11 is less than 180° or an outside corner where the angle between the mounting surfaces 11 is greater than 180°. The endcap 12 or endcap 14 will be angled to match the angle of the inside or outside corner and will have two engagement sections 66 at opposite ends of the endcap 12 or 14 to facilitate connection to both sections of the handrail system 10.

Figure 6:
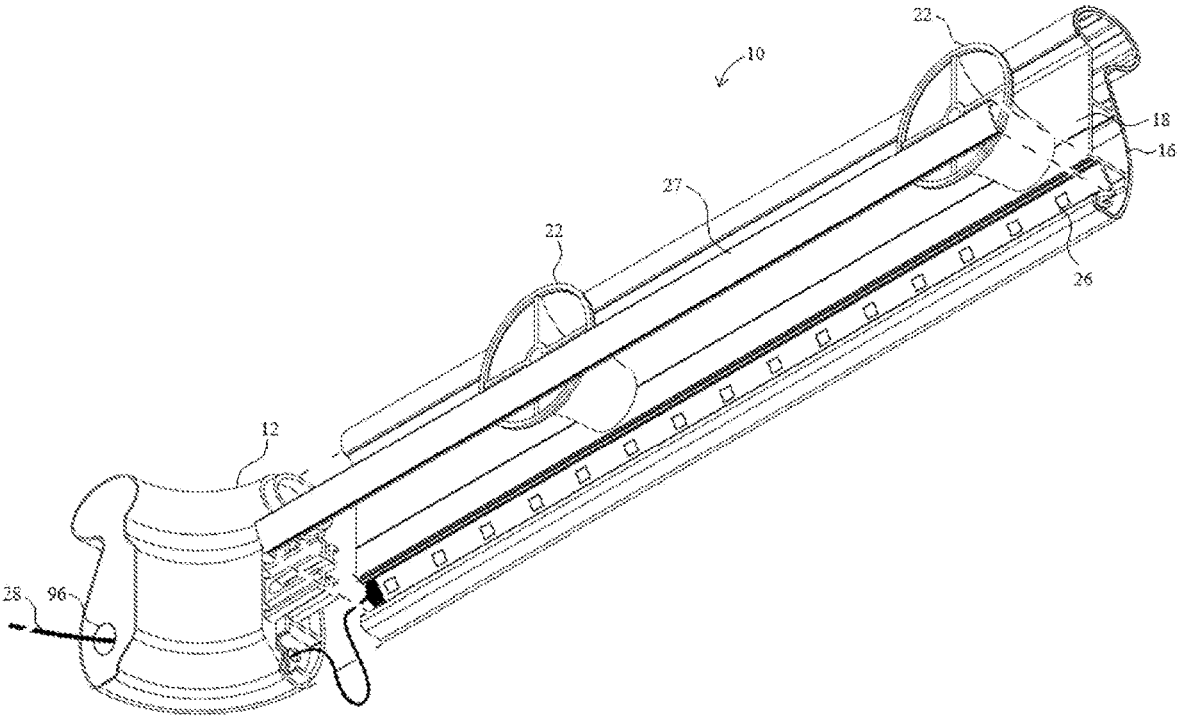
FIG. 6 depicts an exploded perspective view of the handrail system of FIG. 6, according to an exemplary embodiment.

Referring to FIG. 6, an exploded, cross-sectional view of handrail system 10 is shown according to an exemplary embodiment. Lighting assembly 25 includes a power cord 28 that extends from lighting element 26. Power cord 28 is configured to direct electrical energy to lighting element 26 from a power source, such as the electrical system of a building. As shown in FIGS. 5 and 6, endcap 12 includes a conduit 96 that allows power cord 28 to pass through endcap 12 and into mounting surface 11. This configuration is advantageous because it allows for power cord 28 to extend from an end of lighting element 26 and into mounting surface 11 while being concealed within handrail system 10 and not be exposed to passersby.

The handrail system 10 as described herein is simpler to install than other conventional designs. In order to install the handrail system 10 on a mounting surface 11, the endcaps 12, 14 may first be attached to the support member 18. As shown in FIG. 6, the planks 82, 84 are placed on either side of the central strip 20. After securing the endcaps 12, 14 to the support member 18, the support member 18 is connected to the mounting surface 11 as shown in FIG. 4. A fastener 104 is inserted through a hole in the central strip 20 of the support member 18. The hole may be drilled at the time of installation, or the hole may be predrilled. The fastener passes through a hole in mounting arm 22. The fastener 104 is then secured to a threaded structure 106 in the mounting surface 11. The threaded structure 106 can be a threaded insert embedded into a wall, a drywall anchor, a toggle bolt, a molly, etc. The number of fasteners 104 used to secure the support member 18 to the mounting surface 11 will depend, at least in part, on the length of the support member 18. For example, a fastener 104 may be placed every one to two feet along the length of the support member 18 to secure the support member 18 to the mounting surface 11. While the installation method described involves attaching the endcaps 12, 14 to the support member 18 prior to attaching the support member 18 to the mounting surface 11, in other embodiments the endcaps 12, 14 can be attached after the support member 18 after attaching the support member 18 to the mounting surface 11.

Once the support member 18 and endcaps 12, 14 are secured to the mounting surface 11, the cover 16 is snapped onto support member 18 and endcaps 12, 14. In an embodiment, the second edge 62 of the second curved section 60 of the cover 16 is hooked under the ledge 56. The first edge 48 of the first curved section 46 is then flexed over the curved support section 42. As the first edge 48 extends over curved support section 42, the cover 16 recovers from its flexed state to a relaxed state, which provides tight conformance of the cover 16 to the support member 18 and the endcaps 12, 14 and completes the installation.

Thus, the installation of the handrail system 10 can be completed in three steps: (1) attaching the endcaps 12, 14 to the support member 18; (2) attaching the support member 18 to the mounting surface 11; and (3) attaching the cover 16 to the support member 18. Further, a basic installation only requires four components: the two endcaps 12, 14, the support member 18, and the cover 16. Conventional handrail designs often require additional steps and a greater number of components for the installation. For example, many handrail designs require a mounting bracket be installed on the wall. In such designs, a retainer strip for the endcaps and cover is provided and attached to the mounting bracket. Thus, these designs incorporate at least one additional component and an additional installation step.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

For purposes of this disclosure, the term "about," when referring to a length or distance (e.g., a length of about 10 inches), means within 10 percent above or below the referenced value (e.g., between 9 and 11 inches).

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. As used herein, the article "a" is intended to include one or more component or element and is not intended to be construed as meaning only one.

What is claimed is:

1. A handrail configured to be installed on a mounting wall, the handrail comprising:

an elongate support member having a first longitudinal end, a second longitudinal end, and a longitudinal axis extending through the first longitudinal end and the second longitudinal end, the support member comprising:

a base member having a first side that faces toward the mounting wall when the support member is installed and a second side that faces away from the mounting wall when the support member is installed, the base member including a channel formed in the first side and extending in a direction parallel to the longitudinal axis, wherein the channel faces in a direction toward the mounting wall when the support member is installed; and a mounting arm extending from the first side of the base member, the mounting arm configured to engage the mounting wall when the support member is installed;

a cover configured to couple to the support member, the cover comprising a substantially continuous surface configured to engage the first side of the base member at a first location that is beneath the mounting arm, cover the second side of the base member, and engage the base member at a second location that is above the mounting arm; and a lighting element coupled to the base member within the channel such that light emitted by the lighting element is directed away from the second side of the base member;

wherein the base member is a separate, discontinuous component from the cover such that the cover can be coupled to and removed from the base member while the lighting element is coupled to the base member.

2. The handrail of claim 1, wherein the base member further comprises a central strip, a curved extension that extends from an upper portion of the central strip in a direction toward the mounting wall when the support member is installed, and a curved support section that extends from the curved extension in a direction away from the mounting wall when the support member is installed.

3. The handrail of claim 2, wherein the substantially continuous surface of the cover defines an upper curved section, wherein the curved support section comprises a curved surface configured to engage and support the upper curved section, and wherein a curvature of the curved surface substantially matches a curvature of the upper curved section.

4. The handrail of claim 3, wherein a portion of the cover below the upper curved section has a concave curvature.

5. The handrail of claim 1, wherein the cover is comprised of impact resistant plastic that allows the cover to snap onto the support member during assembly.

6. The handrail of claim 1, wherein the support member includes aluminum.

7. The handrail of claim 1, wherein the support member includes a material from the group consisting of metal, wood, and plastic.

8. The handrail of claim 1, the lighting element including a plurality of light emitting diodes.

9. The handrail of claim 1, wherein the lighting element is a singular linear lighting element.

10. The handrail of claim 1, wherein the light emitted by the lighting element is accent room lighting.

11. The handrail of claim 1, wherein the channel defines an opening along the first side of the base member, and wherein the opening is oriented in the direction toward the mounting wall when the elongate support member is installed.

12. The handrail of claim 11, further comprising a lighting cover that is positioned within the opening and covers the channel.

13. The handrail of claim 1, wherein the first location of the first side of the base member is beneath the channel.

14. A handrail configured to be installed on a mounting wall, the handrail comprising:

an elongate support member having a first longitudinal end, a second longitudinal end, and a longitudinal axis extending through the first longitudinal end and the second longitudinal end, the support member comprising:

a base member having a first side that faces toward the mounting wall when the support member is installed and a second side that faces away from the mounting wall when the support member is installed, the base member including a channel that extends in a direction parallel to the longitudinal axis, wherein the channel faces in a direction toward the mounting wall when the support member is installed; and a mounting arm extending from the first side of the base member, the mounting arm configured to engage the mounting wall when the support member is installed;

a cover configured to couple to the support member, the cover comprising a substantially continuous surface configured to engage the first side of the base member at a first location that is beneath the mounting arm, cover the second side of the base member, and engage the base member at a second location that is above the mounting arm; and a lighting element coupled to the base member within the channel, the lighting element including a power cord for directing electrical energy to the lighting element from a power source;

an endcap having a first endcap end and a second endcap end, the first endcap end being coupled to the first longitudinal end of the support member, and the endcap forming an arcuate shape that defines an arc between the first endcap end and the second endcap end;

wherein the power cord of the lighting element passes through the endcap from the lighting element to the mounting wall.

15. The handrail of claim 14, wherein the base member is a separate, discontinuous component from the cover such that the cover can be coupled to and removed from the base member while the lighting element is coupled to the base member.

16. The handrail of claim 14, wherein the channel is formed in the first side of the base member such that light emitted by the lighting element is directed away from the second side of the base member; and wherein the light emitted by the lighting element is accent room lighting.

17. The handrail of claim 14, wherein the lighting element is a singular linear lighting element.

18. The handrail of claim 14, wherein the endcap is comprised of impact resistant plastic.

19. The handrail of claim 14, wherein the channel is configured such that the lighting element can be installed in and removed from the base member while the handrail is installed on the mounting wall and while the cover is coupled to the support member.

20. A handrail configured to be installed on a mounting wall, the handrail comprising:

an elongate support member having a first longitudinal end, a second longitudinal end, and a longitudinal axis extending through the first longitudinal end and the second longitudinal end, the support member comprising:

a base member having a first side that faces toward the mounting wall when the support member is installed and a second side that faces away from the mounting wall when the support member is installed, the base member including a channel formed in the first side and extending in a direction parallel to the longitudinal axis, wherein the channel faces in a direction toward the mounting wall when the support member is installed; and a mounting arm extending from the first side of the base member, the mounting arm configured to engage the mounting wall when the support member is installed;

a cover coupled to the support member, the cover comprising a substantially continuous surface configured to engage the first side of the base member at a first location that is beneath the mounting arm, cover the second side of the base member, and engage the base member at a second location that is above the mounting arm; and a lighting element coupled to the base member within the channel such that light emitted by the lighting element is directed away from the second side of the base member;

wherein the channel is configured such that the lighting element can be installed in and removed from the base member while the handrail is installed on the mounting wall and while the cover is coupled to the support member.

21. The handrail of claim 20, wherein an upper portion of the base member defines a curved support section, wherein a portion of the cover engages the curved support section, and wherein a curvature of the curved support section matches the curvature of the portion of the cover that engages the curved support section.

22. The handrail of claim 20, wherein the base member is a separate, discontinuous component from the cover such that the cover can be coupled to and removed from the base member while the lighting element is coupled to the base member.

23. The handrail of claim 20, wherein the lighting element is a singular linear lighting element.

* * * * *